US010086578B2

(12) United States Patent
Lopez et al.

(10) Patent No.: US 10,086,578 B2
(45) Date of Patent: Oct. 2, 2018

(54) ADHESIVE ACTIVATION MACHINE FOR ROUND SURFACES

(71) Applicant: FLEXTRONICS AP, LLC, San Jose, CA (US)

(72) Inventors: Mario Lopez, Jalisco (MX); Victor Najar, Jalisco (MX); Guillermo Arriaga Contreras, Coahuila (MX)

(73) Assignee: FLEXTRONICS AP, LLC, San Jose, CA (US)

( * ) Notice: Subject to any disclaimer, the term of this patent is extended or adjusted under 35 U.S.C. 154(b) by 834 days.

(21) Appl. No.: 14/673,164

(22) Filed: Mar. 30, 2015

(65) Prior Publication Data

US 2016/0288441 A1 Oct. 6, 2016

(51) Int. Cl.
*B30B 7/04* (2006.01)
*B30B 11/00* (2006.01)

(52) U.S. Cl.
CPC ..... *B30B 7/04* (2013.01); *B30B 11/007* (2013.01)

(58) Field of Classification Search
CPC . B30B 7/04; B30B 11/007; F21K 9/90; F21K 9/23; B29C 66/81463; B29C 66/53261; B29C 66/81423; B29C 66/5326
See application file for complete search history.

(56) References Cited

U.S. PATENT DOCUMENTS

| | | | | |
|---|---|---|---|---|
| 7,194,951 | B1 * | 3/2007 | Porter | A47J 31/005 100/116 |
| 8,402,888 | B2 * | 3/2013 | Baccetti | A47J 31/20 100/116 |
| 2001/0015056 | A1 * | 8/2001 | Hiramoto | B29C 65/18 53/479 |
| 2016/0144609 | A1 * | 5/2016 | Ruiz | F21K 9/23 156/228 |

* cited by examiner

*Primary Examiner* — Jimmy T Nguyen
(74) *Attorney, Agent, or Firm* — Volpe and Koenig, P.C.

(57) ABSTRACT

A press apparatus and a press including the press apparatus include a circular nest and a circular pressure shoe made up of press blocks formed as radial segments with an inside diameter corresponding to the diameter of the circular nest. The press blocks are fitted to actuators to move the press blocks between a first position in which the press blocks are radially outwardly spaced away from the nest and a second position the press blocks are radially inwardly disposed so that the inner radii of the press blocks are aligned to form a circle concentric with the circular nest.

8 Claims, 5 Drawing Sheets

ADHESIVE ACTIVATION MACHINE FOR ROUND SURFACES

FIELD OF INVENTION

The present invention relates to a press, more particularly a press for applying force to round surfaces.

BACKGROUND

In production environments, presses are often used to apply forces to articles of manufacture, for example to activate a pressure sensitive adhesive to form an adhesive bond. To bond an adherend to an article with a uniform bond strength, it is often desirable to apply a uniform pressure simultaneously to all bonding surfaces.

Presses for applying a uniform force to a continuous flat or curved article are known. Current presses are inadequate to apply a uniform force to an object with a round surface to achieve a uniform, repeatable bond. Accordingly, a need exists for a press for applying a uniform force to round surfaces.

SUMMARY

Embodiments of a press for applying force to round surfaces are provided herein. In some embodiments, a press apparatus comprises a circular nest. A segmented circular pressure shoe is concentrically disposed around a circumference of the nest comprising a plurality of press blocks formed as radial annular segments having an inner radius corresponding to a radius of the circular nest and an outer radius. Linear actuators, corresponding in number to the plurality of press blocks, are provided. The linear actuators are displaceable between a first position and a second position, both positions being along a radius of a circle concentric with the circular nest. The press blocks are individually mounted to an actuator so that in the first position, the press blocks are extended radially outwardly and the inner radius is spaced from the circumference of the nest, and in the second position the press blocks are extended radially inwardly with the inner radius of each press block aligned with the inner radius of adjacent press blocks forming a circle concentric with the circular nest.

In some embodiments, a press comprising a frame with a press apparatus mounted to the frame. The press apparatus includes a circular nest. A segmented circular pressure shoe is concentrically disposed around a circumference of the nest comprising a plurality of press blocks formed as radial annular segments having an inner radius corresponding to a radius of the circular nest and an outer radius. Linear actuators, corresponding in number to the plurality of press blocks, are provided. The linear actuators are displaceable between a first position and a second position, both positions being along a radius of a circle concentric with the circular nest. The press blocks are individually mounted to an actuator so that in the first position, the press blocks are extended radially outwardly and the inner radius is spaced from the circumference of the nest, and in the second position the press blocks are extended radially inwardly with the inner radius of each press block aligned with the inner radius of adjacent press blocks forming a circle concentric with the circular nest. The press apparatus is mounted to the frame so that the circular nest is centrally located within the frame. A cover is provided with a circular centering fixture mounted thereto, the cover movably mounted to the frame and movable between a first position and a second position.

In the first position the centering fixture is adjacent to and coaxially located with the circular nest and in the second position the centering fixture is spaced apart from the circular nest.

Other and further embodiments of the present invention are described.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
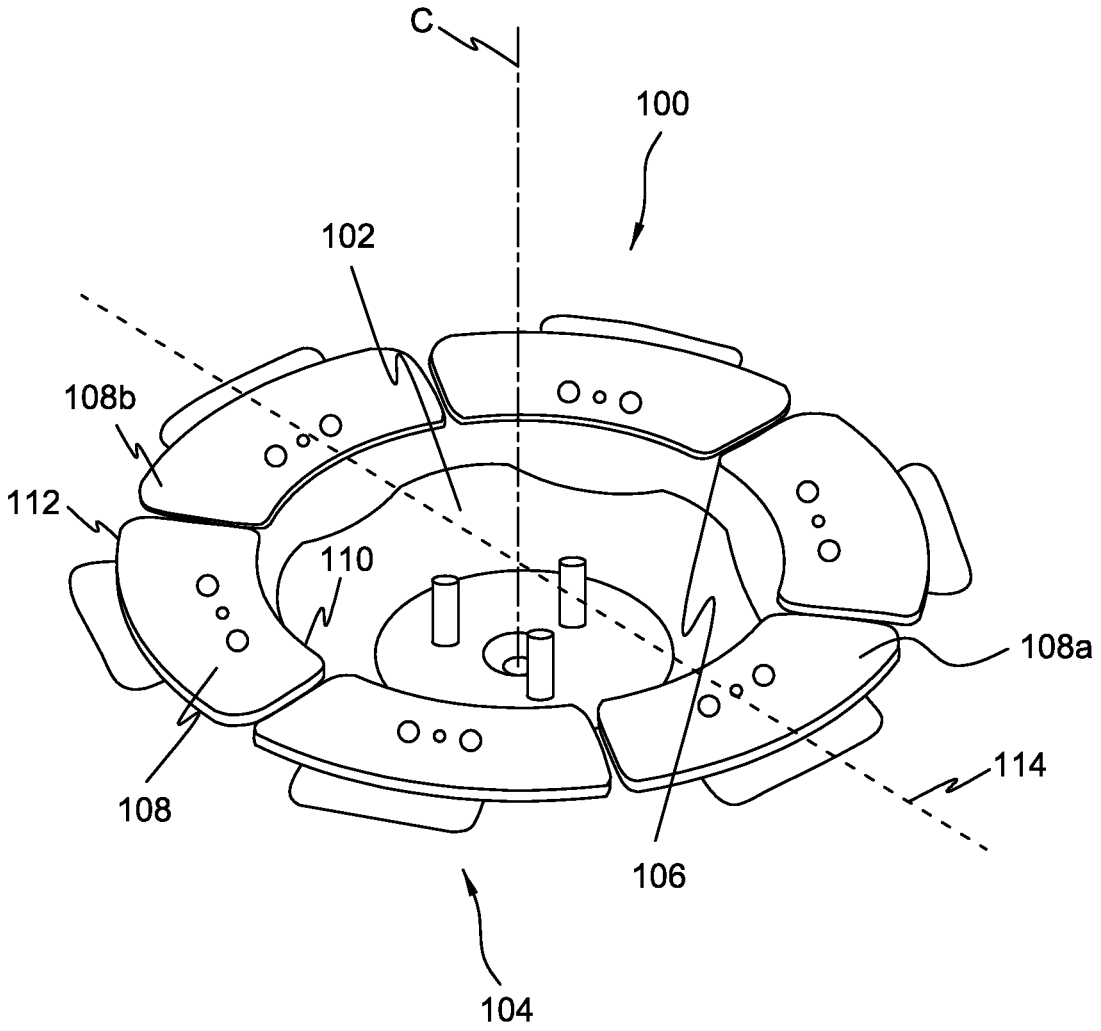
FIG. 1 is a perspective view of a press apparatus in accordance with an embodiment of this disclosure.
Figure 2:
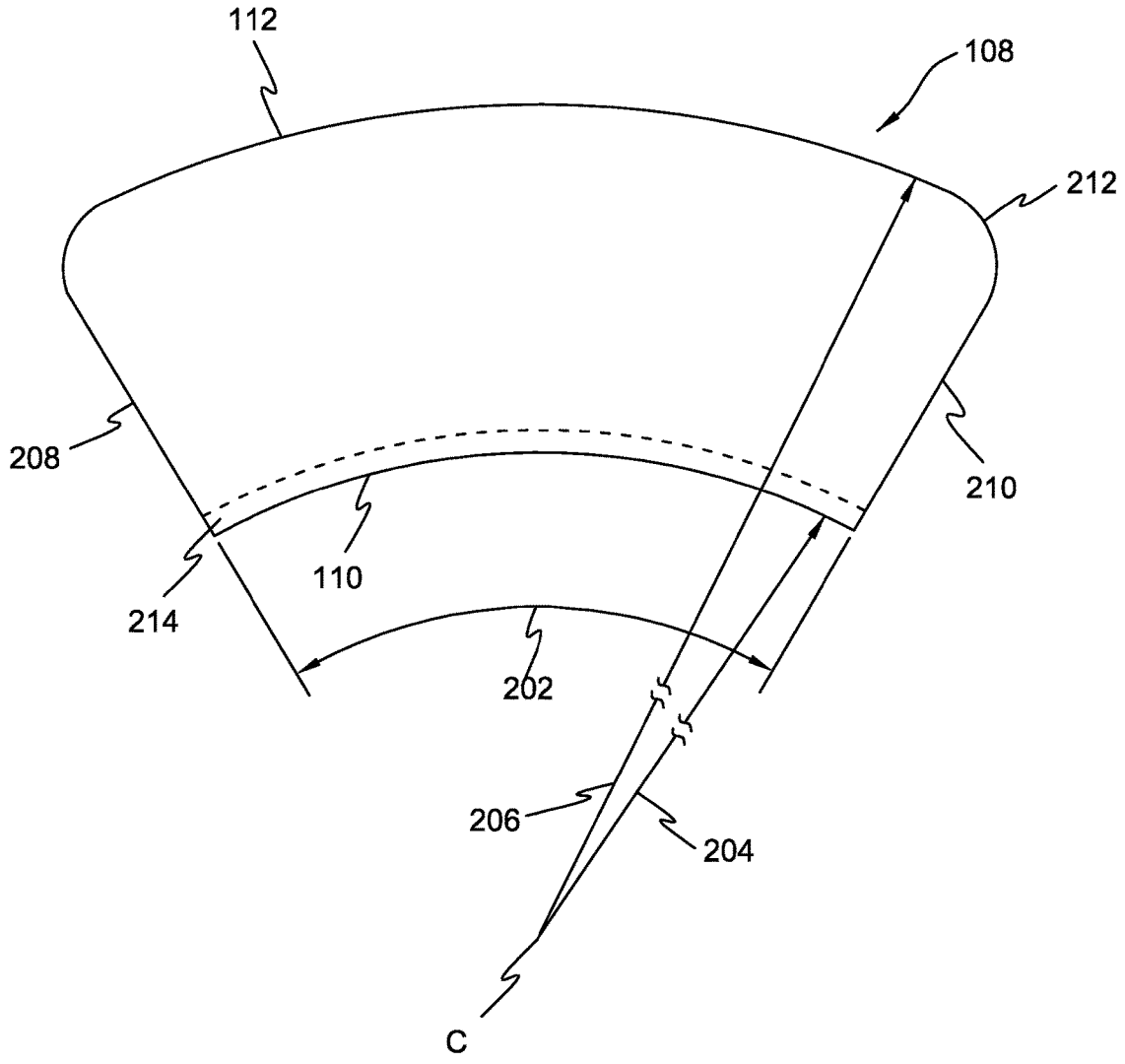
FIG. 2 is a top view of a press shoe in accordance with an embodiment of this disclosure.

To facilitate understanding, identical reference numerals have been used, where possible, to designate identical elements that are common in the figures. The figures are not drawn to scale and may be simplified for clarity. It is contemplated that elements and features of one embodiment may be beneficially incorporated in other embodiments without further recitation.

While described in reference to a press for applying force to round surfaces, the present invention may be modified for a variety of applications while remaining within the spirit and scope of the claimed invention, since the range of the potential applications is great, and because it is intended that the present invention be adaptable to many such variations.

DETAILED DESCRIPTION

Certain terminology is used in the following description for convenience only and is not limiting. The words "front," "rear," "upper" and "lower" designate directions in the drawings to which reference is made. The words "radially inwardly" and "radially outwardly" refer to directions radially toward and away from an axis of the part being referenced. "Axially" refers to a direction along the axis of a shaft or other part. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

FIG. 1 is a top perspective view of an exemplary press apparatus 100 comprising a circular nest 102 and a segmented circular pressure shoe 104 disposed around the circumference of the nest 102. The circular nest 102 and the pressure shoe 104 are concentrically formed about C.

The pressure shoe 104 is composed of a plurality of press blocks 108 (6 shown) formed as radial annular segments (i.e., radial segments of an annulus). The press blocks 108 have an inner curved surface 110 and an outer curved surface 112.

The radii extend from first end 208 to second end 210 with radii 204 corresponding with the radius of the circumference of the circular nest 102 and radii 206 corresponding with the radius of the circumference of the outer curved surface 112 of the press block 108. The intersection of outer radius 112 and each end 208, 210 may include a chamfer or radius 212. Ends 208 and 210 are portions of radial lines centered at C, and form an included angle 202 which is, in a preferred embodiment, uniform for all press blocks 108 comprising a particular pressure shoe 104. Consequently, the press blocks 108 have the same arc length, which corresponds with angular measure 202. The angle 202 varies depending on the number of press blocks 108 used. For example, in the non-limiting embodiment of FIG. 1, angle 202 would be 60 degrees for 6 press blocks 108.

The inner diameter 110 of the press block 108 may include an undercut 214 extending radially outwardly from the inner radius 110.

Figure 3:
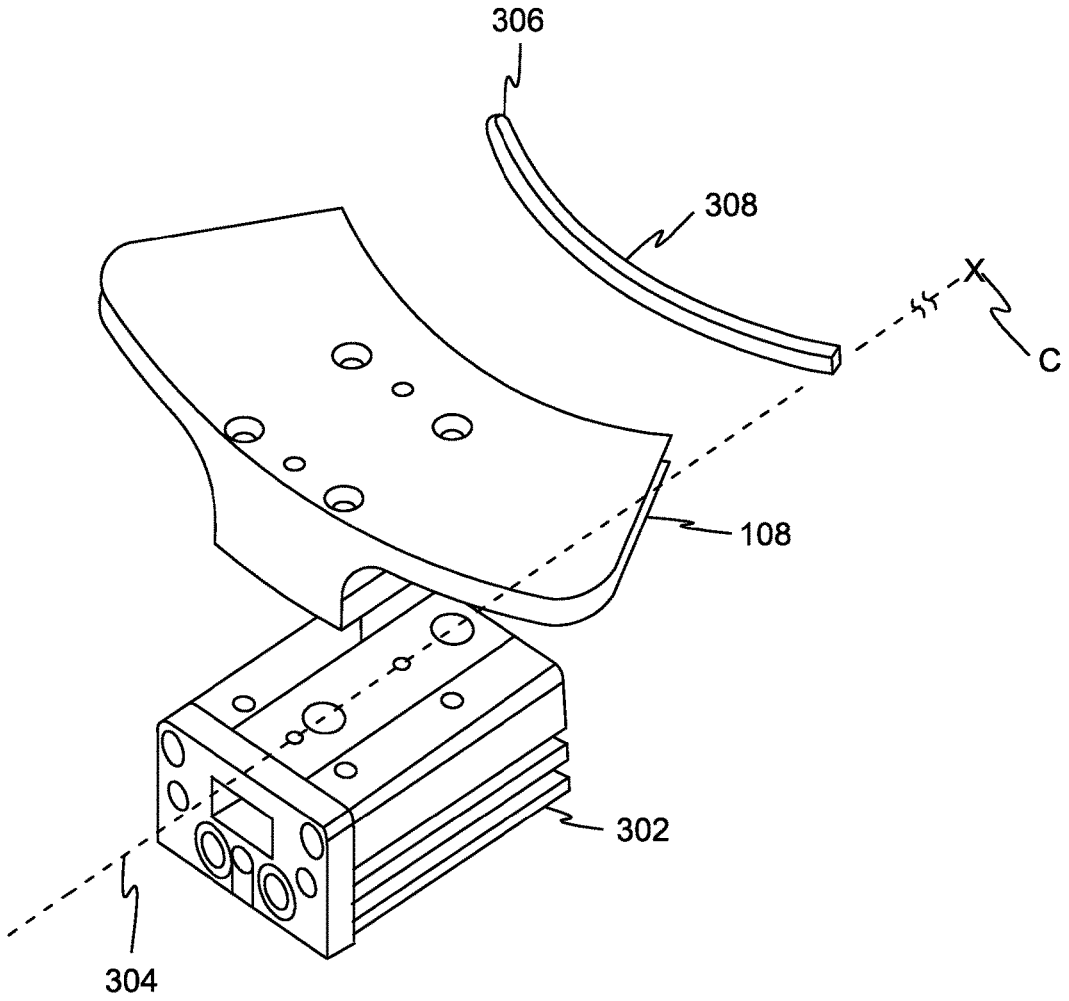
FIG. 3 is an exploded perspective view of a press shoe and actuator in accordance with an embodiment of this disclosure.

The non-limiting embodiment of FIG. 3 is an exploded view of a press block 108 individually mounted to an actuator 302, for example a linear actuator, so that one press block 108 is mounted to one actuator 302. In some embodiments, it may be desirable to mount one press block 108 to more than one actuator 302 or more than one press block 108 to one actuator 302. The actuator 302 is displaceable along a line of action 304 that is a radius of a circle concentric with the circular nest 102 between a first position and a second position (shown in FIG. 1) radially closer to the center C of the nest 102. In a preferred embodiment, press blocks 108 are arranged in diametrically opposed pairs (for example press blocks 108*a* and 108*b* opposed along diameter 114).

When the actuator 302 is in the second position (FIG. 1), radially closer to the center C than the first position, the press blocks 108 are positioned such that first end 208 is in an abutting relationship with second end 210 of an adjacent press block. In the second position (FIG. 1), the inner radius 204 of each press block 108 is aligned with the inner radius 204 of adjacent press blocks 108 so that the combined radii of all press blocks 108 form a circle 106 concentric with the circular nest 102.

An insert 306 may be placed in the undercut 214 of the press block 108 to provide a contact face 308 with preferred properties. For example insert 306 may be a cushioning or protective material to limit damage to the pressed object, or may be a material with enhanced wear properties to protect the press blocks 108 from wear.

The actuators 302 have the same, or substantially the same, linear displacement between the first position and the second position and are controlled to apply the same, or substantially the same, force at least when displaced between the first position and the second position. In a preferred embodiment, the actuators 302 are controlled to move substantially simultaneously between the first and second positions. The actuators may be individually controlled, or controlled as a group, for one or more of linear displacement distance, radial position in the first or second positions, force applied, displacement speed between the first and second positions, or timing for displacement in one or both of first position to the second position or second position to first position.

Figure 4:
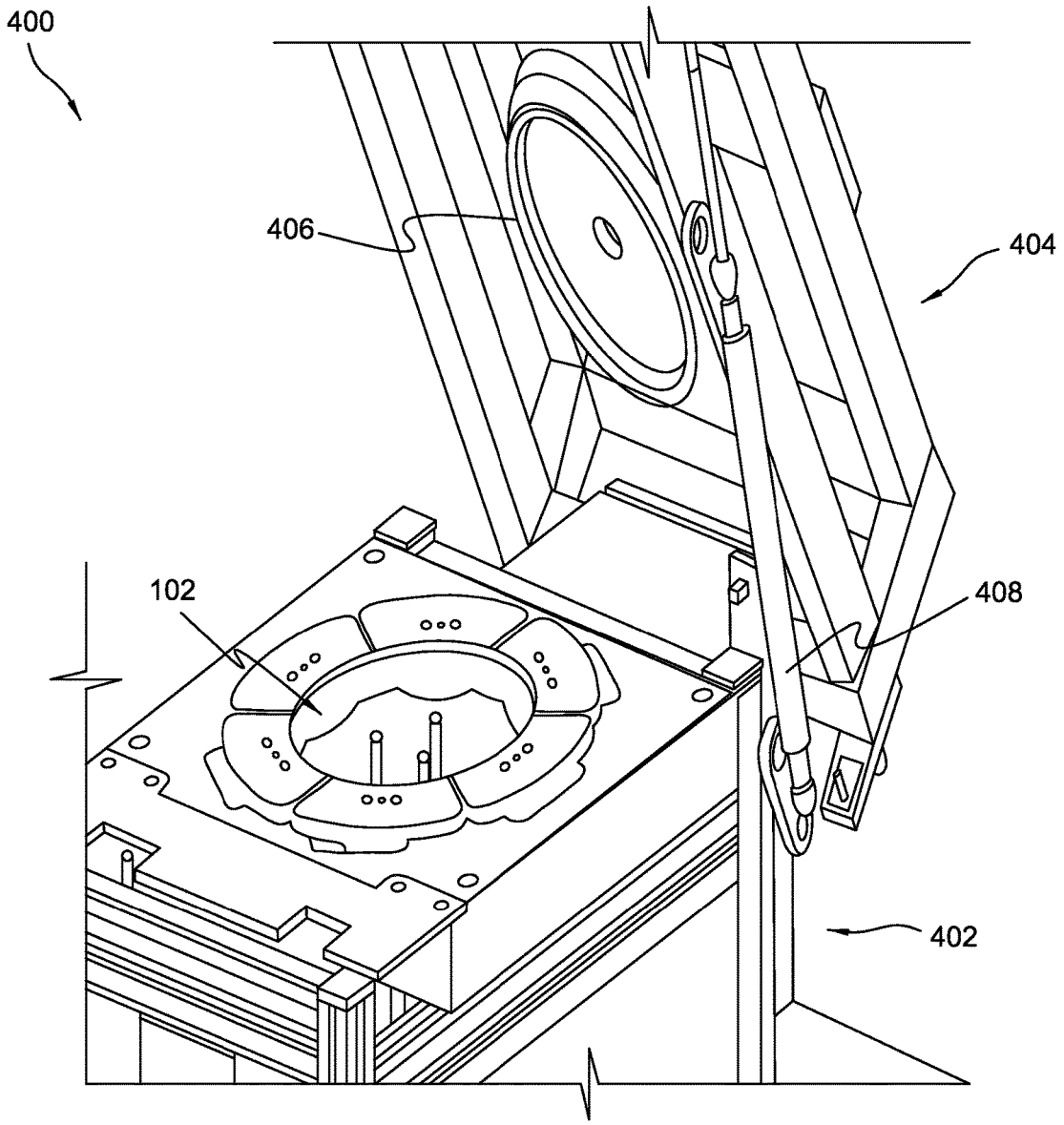
FIG. 4 is a perspective view of a press incorporating the press apparatus of FIG. 1 in accordance with an embodiment of this disclosure in an open position.
Figure 5:
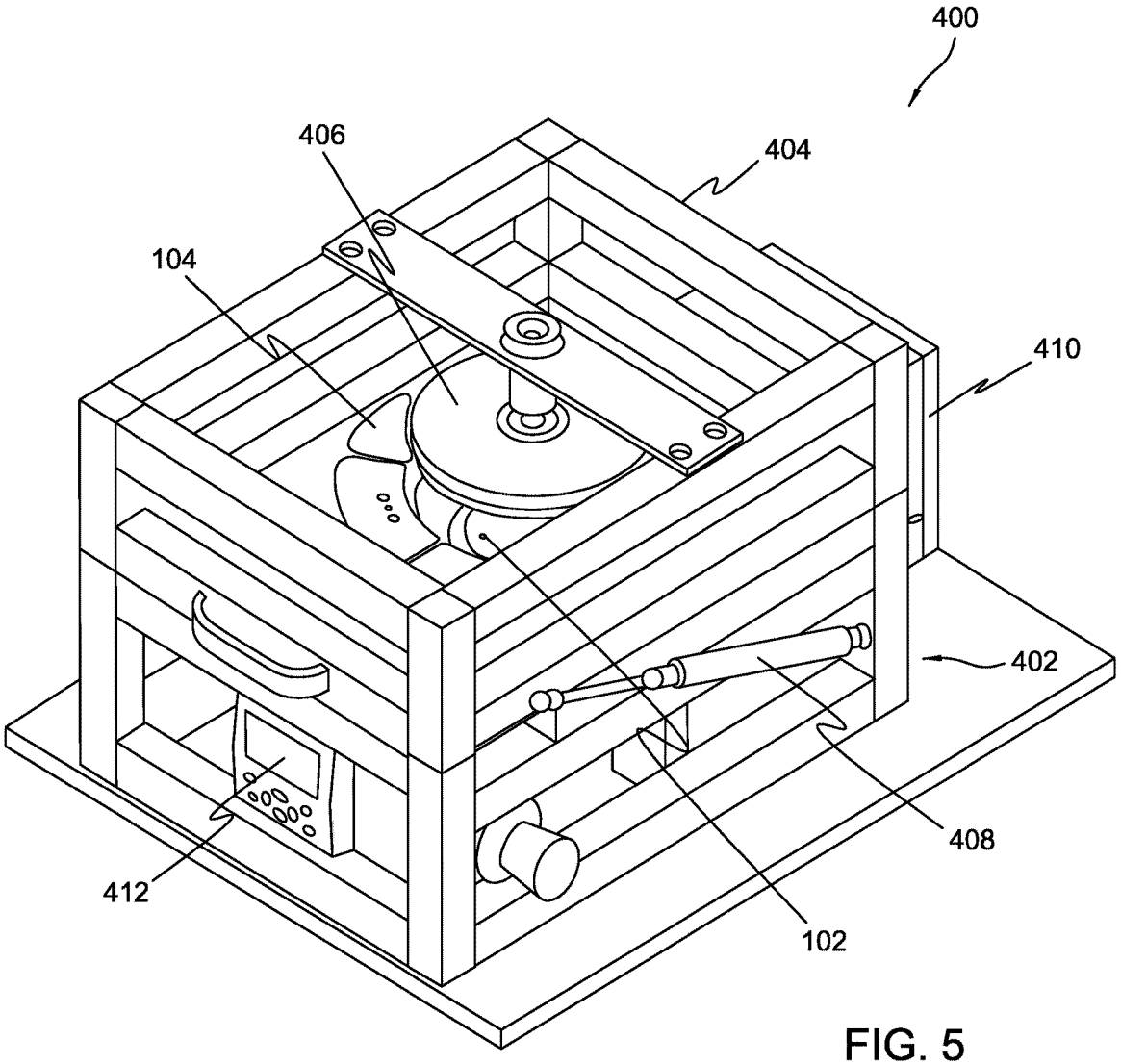
FIG. 5 is a perspective view of the press of FIG. 4 in a closed position.

In an embodiment, the press apparatus 100 may be included in a pressing machine or press 400. The press 400 includes the press apparatus 100 mounted to a frame 402 so that the circular nest 102 is located within the frame 402, preferably centrally located within the frame 402. In a preferred embodiment, the press 400 includes a cover 404 movably mounted to the frame 402 movable between at least a first position (FIG. 5) and a second position (FIG. 4). The cover includes a centering fixture 406, for example a circular centering fixture as shown in FIG. 4. In the first position (FIG. 5) the centering fixture 406 is adjacent to and coaxially located with the circular nest 102. An operating mechanism 408, for example an actuator shown in FIGS. 4 and 5, may be used to facilitate moving the cover 404 between the first position (FIG. 5) and the second position (FIG. 4).

The press 400 may include a control system, for example a programmable controller 412, operatively coupled to the press to monitor and/or control systems on the press, for example the operation of the pressure apparatus 100, and the frame 402 and cover 404.

The press 400 includes a connection point, for example junction box 410 to provide power to the press 400. Power may include electrical power and a pressure medium, for example compressed air, to operate the various systems of the press including the pressure shoe 104 and the operating mechanism 408.

Thus, a press apparatus for applying force to round surfaces and a press using the apparatus are provided herein. The inventive press apparatus and press advantageously eliminates, or substantially reduces the uneven application of pressure to round surfaces, for example in operations using the sensitive adhesives. Accordingly, the throughput of the press may be advantageously impacted by eliminating, or substantially reducing, poor adhesive activation and bond formation thereby improving manufacturing capacity.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A press apparatus comprising:

a circular nest;

a segmented circular pressure shoe concentrically disposed around a circumference of the nest comprising a plurality of press blocks formed as radial annular segments having an inner radius corresponding to a radius of the circular nest and an outer radius; and linear actuators, corresponding in number to the plurality of press blocks, the linear actuators are displaceable between a first position and a second position, both positions being along a radius of a circle concentric with the circular nest, wherein the press blocks are individually mounted to an actuator so that in the first position, the press blocks are extended radially outwardly and the inner radius is spaced from the circumference of the nest, and in the second position the press blocks are extended radially inwardly with the inner radius of each of the press blocks aligned with the inner radius of adjacent press blocks of the press blocks forming a circle concentric with the circular nest.

2. The apparatus of claim 1, wherein the radial annular segments are equal in arc length.

3. The apparatus of claim 1, wherein the actuators are controlled to each apply a same force to an article placed in the circular nest.

4. The apparatus of claim 1, wherein each actuator has the same linear displacement between the first position and the second position.

5. The apparatus of claim 1, wherein the actuators move substantially simultaneously at least between the first position and the second position.

6. The apparatus of claim 1, wherein the actuators are individually controlled.

7. A press comprising:

a frame;

a press apparatus comprising: a circular nest, a segmented circular pressure shoe concentrically disposed around a circumference of the nest comprising a plurality of press blocks formed as radial annular segments having an inner radius corresponding to a radius of the circular nest and an outer radius, and linear actuators, corresponding in number to the plurality of press blocks, the linear actuators are displaceable between a first position and a second position, both positions being along a radius of a circle concentric with the circular nest, wherein the press blocks are individually mounted to an actuator so that in the first position, the press blocks are extended radially outwardly and the inner radius is spaced from the circumference of the nest, and in the second position the press blocks are extended radially inwardly with the inner radius of each of the press blocks aligned with the inner radius of adjacent press blocks of the press blocks forming a circle concentric with the circular nest, and wherein the press apparatus mounted to the frame so that the circular nest is centrally located within the frame;

a cover with a circular centering fixture mounted thereto, the cover movably mounted to the frame and movable between a first position and a second position, wherein, in the first position the circular entering fixture is adjacent to and coaxially located with the circular nest and in the second position the circular centering fixture is spaced apart from the circular nest.

8. The press of claim 7, wherein an actuator is adapted to move the cover between the first position and the second position.

* * * * *